US008439658B2

(12) United States Patent
Johnson

(10) Patent No.: US 8,439,658 B2
(45) Date of Patent: May 14, 2013

(54) PROGRESSING CAVITY PUMP RUBBER REINFORCEMENT DEVICE FOR ROTOR ALIGNMENT

(75) Inventor: Nicholas D. Johnson, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 756 days.

(21) Appl. No.: 12/611,531

(22) Filed: Nov. 3, 2009

(65) Prior Publication Data

US 2011/0103989 A1 May 5, 2011

(51) Int. Cl.

| | |
|---|---|
| ***F01C 1/10*** | (2006.01) |
| ***F01C 1/107*** | (2006.01) |
| ***F04C 2/10*** | (2006.01) |
| ***F04C 2/107*** | (2006.01) |
| ***F04C 5/00*** | (2006.01) |

(52) U.S. Cl.

USPC ..... 418/48; 418/50; 418/152; 418/153; 418/156; 166/68.5; 166/68; 166/105; 464/162

(58) Field of Classification Search ..... 418/48, 418/50, 152, 153, 156; 166/68.5, 68, 105; 464/162–169; 403/109.1

See application file for complete search history.

(56) References Cited

U.S. PATENT DOCUMENTS

| | | | | |
|---|---|---|---|---|
| 1,892,217 | A | 12/1932 | Moineau | |
| 2,028,407 | A | 1/1936 | Moineau | |
| 3,840,154 | A * | 10/1974 | Speak | 222/181.2 |
| 5,209,294 | A | 5/1993 | Weber | |
| 5,725,053 | A | 3/1998 | Weber | |
| 6,170,572 | B1 * | 1/2001 | Fulbright et al. | 166/68.5 |
| 7,201,222 | B2 | 4/2007 | Kanady et al. | |
| 7,905,714 | B2 * | 3/2011 | Gerling | 418/48 |
| 2009/0136371 | A1 | 5/2009 | Gerling | |

* cited by examiner

*Primary Examiner* — Mary A Davis
(74) *Attorney, Agent, or Firm* — Steve Rosenblatt

(57) ABSTRACT

A progressing cavity pump assembly utilizes a reinforced upper section of the stator rubber helix. The pump stator is located at the end of a string of tubing. The reinforced upper section of the stator rubber helix is strong enough, whether reinforced by mechanical means or by strengthening the rubber matrix chemically, so as not to allow the passage of a stop located above or on the top of the pump rotor. The rotor is lowered on a string of rods until the stop above or on top of the rotor lands onto the reinforced upper section of the stator rubber helix. The rotor is then repositioned away from the stator helix a predetermined distance before pump operation begins with rod string rotation.

23 Claims, 3 Drawing Sheets

PROGRESSING CAVITY PUMP RUBBER REINFORCEMENT DEVICE FOR ROTOR ALIGNMENT

FIELD OF THE INVENTION

The field of the invention is Moineau progressing cavity pumps for subterranean use and more particularly to a feature that facilitates rotor alignment with the stator where the tag shoulder is a reinforced upper section of the stator.

BACKGROUND OF THE INVENTION

Progressing cavity pumps (PCP) were invented in the 1930s by Moineau as seen in U.S. Pat. Nos. 1,892,217 and 2,028,407.

A progressing cavity pump has a stator and a rotor. The stator typically comprises an elastomeric liner within a housing. The stator is open at both ends and has a multi-lobe helical passage extending through it. The rotor is normally of metal and has a helical exterior formed on it. Rotating the rotor causes fluid to pump through the stator. Progressing cavity pumps are used for a variety of purposes.

As a well pump, progressing cavity pumps may be driven by a downhole electrical motor or by a string of rods extending to a motor located at the surface. With a rod driven pump, normally the stator is suspended on a string of tubing, and the drive rods are located within the tubing. When installing a rod driven progressing cavity pump, the operator first secures the stator to the string of tubing and runs the tubing into the well to a desired depth. The operator then lowers the rotor through the tubing on the string of rods and into the stator. To operate the pump at desired capacity, the rotor must be at the desired axial spacing within the stator and the rods must be in tension. If the lower end of the rotor is spaced above a lower end of the stator during operation, then a lower portion of the stator will not be in engagement with the rotor and the pumping capacity will suffer. The operator thus needs to know when the rotor has fully entered the stator during installation. The operator can calculate how much the rods will stretch due to the hydrostatic weight of the column of well fluid in the tubing. With the anticipated stretch distance known and with the rotor at a known initial position in the stator, the operator can pull the rods and rotor upward a distance slightly greater than the anticipated stretch, so that during operation, the rotor will move back downward to the desired axial position relative to the stator.

In the prior art, prior to running the tubing, the operator secures or welds a tag bar across the bottom of the stator. During installation, downward movement of the rods will stop when the lower end of the rotor contacts the tag bar at the bottom of the stator. Upon tagging the bar, the operator pulls the rod string back toward the surface by the calculated amount of rod stretch. During operation, as well fluid fills the tubing, the rod stretches, allowing the rotor to move back downward until in full engagement with the stator. If installed properly, once the rods have stretched fully, the lower end of the rotor will be spaced above the tag bar and the rods will be in tension.

While this method works well enough, tag bar creates an obstruction at the bottom of the pump. The obstruction prevents the operator from lowering tooling or instruments through and below the pump for logging, tagging fill, and other monitoring related purposes. Other problems with this approach are the obstruction to flow during operation, and the tendency of sand and well debris to accumulate around the tag bar and clog the intake.

U.S. Pat. No. 7,201,222 teaches of a tag method in which the tag location is an interference shoulder above the pump. The tag shoulder is located above the stator in a reduced diameter collar connected to the tubing, while the rotor tag is connected to the rod string above the rotor. When the rotor is lowered down and reaches its appropriate location relative to the stator, the stop on the rotor rod string interferes with the reduced diameter collar located above the stator in the tubing string, preventing the rotor from progressing further into the stator. While some of the above issues were overcome with this method, there was still the issue of proper placement of the tag bar with respect to the stator. To avoid the eccentric rotation of the rotor, proper distance had to be placed between the tag area and the top of the stator. As the tag location on the collar has to match up directly with the tag location on the rotor rod string, long precision equipment would be required, as well as specialized equipment to prevent the stop on the rotor rod string from damaging the tubing as the rod string rotated. In addition, this method would present more flow obstruction problems, now moved from below the pump to above the pump.

Similarly, U.S. Publication 2009/0136371 suggests a method that lowers the tag surface to just above the stator, by shaping the pass through hole in the tag collar located in the tubing string above the stator or integral with the stator, in such a way that the rotor eccentric motion would not cause the rotor to contact the through hole. More simply, the opening is shaped like the stator helical cavity, so as the collar is placed directly above the stator and timed correctly using a timing jig, the rotor should operate freely in the collar. The rotor tag would then locate on what would be the minor diameter of the collar through hole. To avoid damage from heat if welding was used to secure the tag bar above the stator, there still needed to be a substantial spacing between the stator top and the tag bar. If connections that were threaded were used instead placement issues could exist. A threaded connection was difficult to properly torque while still winding up with the needed alignment of the oblong openings. If the thread had to be backed up after being torqued to align the stator and collar openings then the torque for the connection was reduced, which risked the connection getting subsequently undone while the pump was in service.

Also relevant to issues of rotor placement are U.S. Pat. Nos. 5,209,294 and 5,725,053.

The present invention addresses the issues with top tag systems of the past by removing the need for an additional collar or timing equipment, by simply reinforcing the rubber in the upper section of the stator helix to the point that the rubber will not "give way" to an increased shoulder in the rod string. This also reduces, if not eliminates, the possible cavity between the tag surface and the top of the stator. What allows this to happen is that the upper section of the stator is reinforced in some way, such that when the rotor is delivered on rods its travel stop lands on the reinforced upper stator so that proper alignment is obtained. The rotor is then lifted the requisite amount and the pump is ready to run. These and other advantages of the present invention will be more readily understood by those skilled in the art from a review of the specification describing the preferred embodiment and the associated drawings while recognizing that the full scope of the invention is to be found in the appended claims.

SUMMARY OF THE INVENTION

In one embodiment of this invention, the upper section of the rubber stator helix is reinforced with reinforcement tags. The reinforcement tags are secured inside a stator housing through holes in the housing wall. An adhesive can be applied to the housing inner wall. The stator core is then inserted in the stator housing with the reinforcement tag segments secured. By inserting the reinforcing tags prior to rubber injection, the core can be aligned with the tags, eliminating the need for later timing devices. Also, the core can be inserted prior to the tags being placed. End caps are placed over the core and rubber or other resilient material is injected into the annular space between the core and the housing inner wall until the space is filled as noted when the resilient material exits the end caps. The end caps and core are removed leaving the reinforcement tags embedded in the stator helix. The rotor advances until it lands on the rubber just above the reinforcement tags and in alignment with the stator.

Alternatively, the stator helix composition can be chemically altered in the location where the tags would otherwise go so as to integrate the tags into the stator and properly locate this harder segment with respect to the core to eliminate the need for subsequent timing devices.

DETAILED DESCRIPTION OF THE PREFERRED EMBODIMENT

Figure 1:
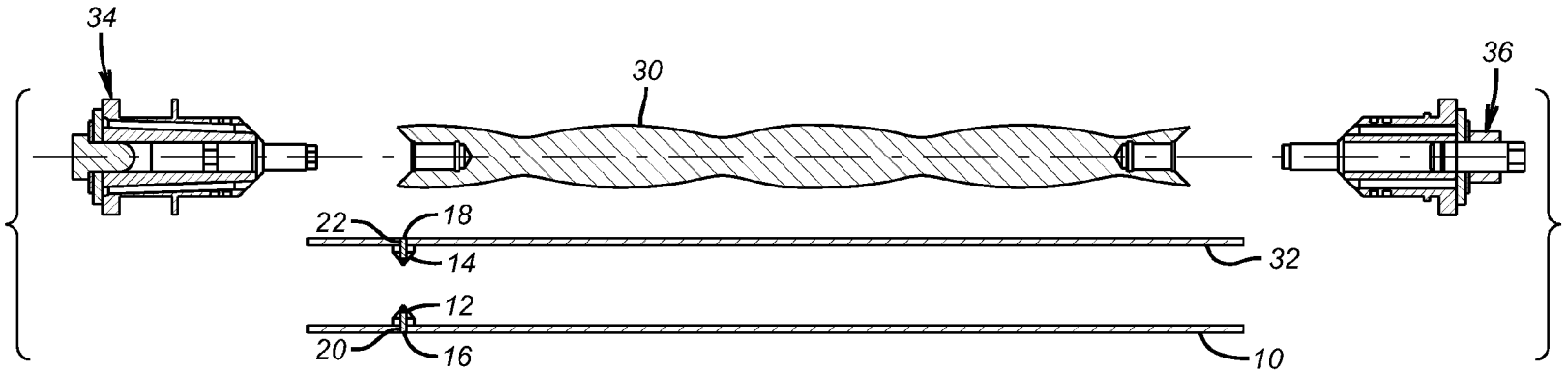
FIG. 1 is an assembly of the components for making the stator before assembly to each other.
Figure 2:
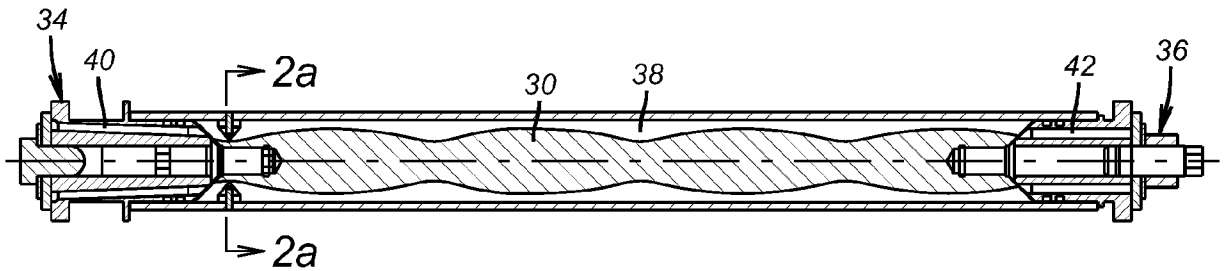
FIG. 2 is the view of FIG. 1 with the components assembled.
Figure 2A:
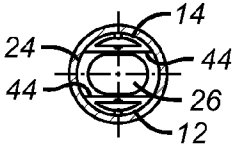
FIG. 2*a* is a section along lines 2*a*-2*a* of FIG. 2.
Figure 3:
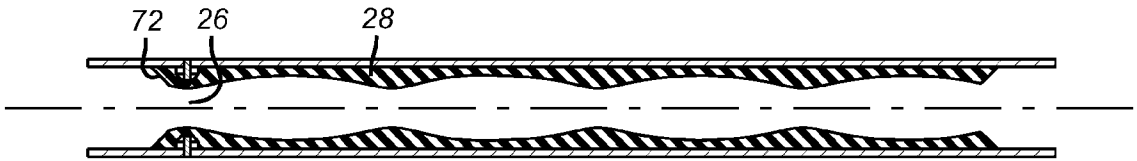
FIG. 3 shows the fabricated stator.
Figure 9:
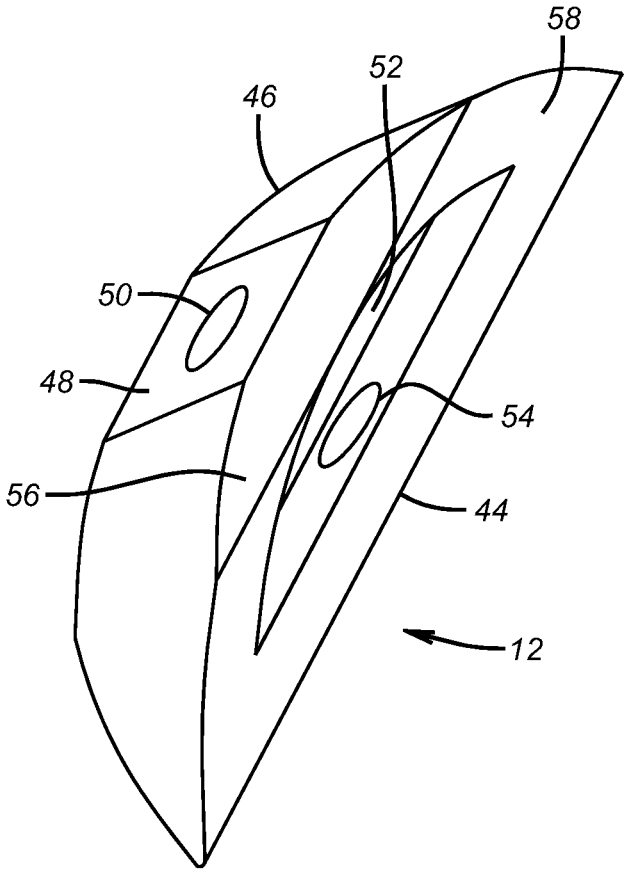
FIG. 9 is a view of one of a pair of top tags.

FIG. 1 illustrates the stator housing 10 with reinforcing tags 12 and 14 secured into position with bolts 16 and 18 extending respectively through wall openings 20 and 22. As seen in FIGS. 2*a* and 9 the reinforcing tags 12 and 14 are preferably located 180 apart and define between them a generally oval shaped opening 24 that is generally aligned with the opening 26 in the stator helix 28 which will be present when the core 30 is removed after the stator 28 is formed by resilient material injection.

In the manufacturing method, the core 30 is placed inside the housing 10 after the housing inside wall 32 and/or the reinforcing tags 12 and 14 are coated with an adhesive. The reinforcing tags 12 and 14 are placed in the housing 10 prior to or after the core 30 is inserted, fixed to the inside wall 32, and the core 30 is rotated to center the helical profile between the reinforcing tags 12 and 14. With the core 30 and reinforcing tags 12 and 14 in the housing 10, the end caps 34 and 36 are attached to the core 30 to center it in housing 10. The annular space 38 is filled with rubber or some other resilient material while the reinforcing tags 12 and 14 are in the annular space 38. The injected material bonds to the adhesive on the inner wall 32 and the top tags 12 and 14 that were in the annular space 38. Except for the presence of the reinforcing tags 12 and 14 in the annular space 38 the remaining steps to form the stator 28 in its housing 10 are well known to those skilled in the art.

Referring to FIGS. 2*a* and 9 the reinforcing tags 12 and 14 are preferably identical and start out as arcuate segments that preferably come to a line end 44. The back 46 of each tag is arcuate to match the shape of the inside wall 32 of the housing 10. As an option the arcuate back 46 can have a flat section 48 which when mounted in the housing 10 will leave a gap to the inside wall 32. During the injection process to form the stator 28 some of the stator material will flow between the wall 32 and the reinforcing tag 12 or 14 so as to seal around the tapped hole 50 that by this time has a fastener 16 or 18 extending through it. It should be noted that each reinforcing tag 12 or 14 starts out without the metal removed at 52. Preferably a blind bore is first drilled to terminate at 54 and threaded to near bottom. Then the material is removed from between back 46 and end 44 leaving the opening 52 through which rubber or what material is used for the stator 28 flows through the tag 12 or 14. Removal of the material leaves the threads in bores 50 and 54 in line so that an advancing fastener will thread into both. Optionally a fastener 20 or 22 can come short of the blind threaded bore 54. As another option the blind bore 54 can have no threads or it can also be a through bore to end 44. As another option, opposed flanks 56 only one of which is shown can be used to get the proper height for each tag 12 or 14 for the size of the housing 10. As best seen in FIG. 2*a* the oblong opening 26 that represents where the core 30 used to be during the manufacturing process, is an opening that is flanked by ends 44 which run parallel to the straight sides of the opening 26. As another option, the tags 12 and 14 can be welded to the housing 10 or the two discrete tags can be formed as a single structure and secured to housing 10 with fasteners 16 or 18 or otherwise secured by other means such as threading, pins or at least one snap ring (when the tags are made of one piece) or welding. It should be noted that when using fasteners 16 or 18 into threaded bore 50 with a flat 48 that the stator 28 material will get into the threads in bore 50 as well as seal around the fasteners 16 or 18 where they extend through an opening in the housing 10.

Figure 4:
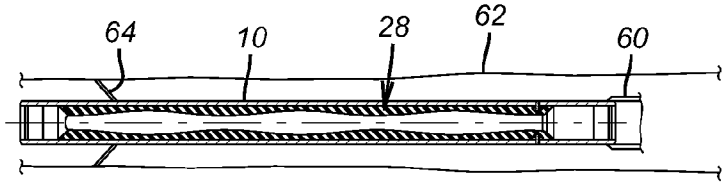
FIG. 4 shows the stator positioned downhole on tubing.
Figure 5:
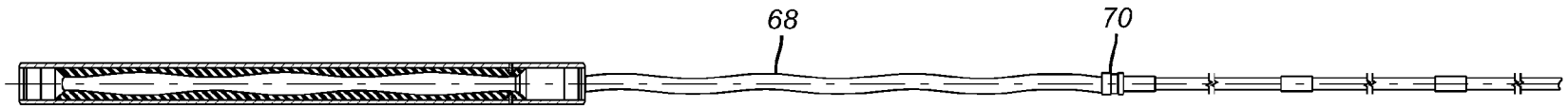
FIG. 5 shows the rotor being lowered on a drive rod toward the stator.

FIG. 4 shows the fully fabricated stator assembly 28 lowered with tubing 60 into a subterranean location such as a well 62 and schematically shown to be anchored at 64 from a structure that extends from the housing 10. In FIG. 5 the rod assembly 66 suspends a rotor 68 that has a travel stop 70 that is designed to land on the reinforced upper stator helix. The travel stop can also be on the rod string above the rotor.

Figure 6:
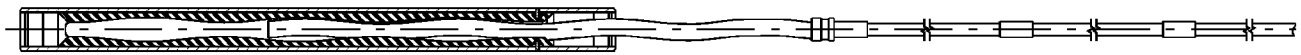
FIG. 6 shows the rotor entering the stator.
Figure 7:
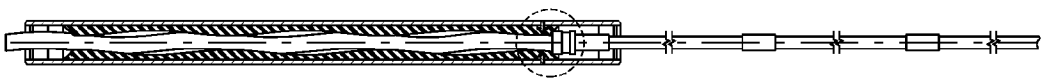
FIG. 7 shows the rotor landing on the rubber above the reinforcing tags.
Figure 8:
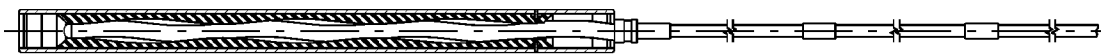
FIG. 8 shows the rotor having been picked up with the rod for operation.

In FIG. 6 the rotor 68 has started advancing into the stator 28 and in FIG. 7 the remaining resilient material of the stator helix above the tags 12 and 14 have been engaged by tapered surface 72 on the rotor 68 marking the travel limit of the rotor 68. As shown in FIG. 8, the rotor 68 is lifted the proper height for relative spacing to the stator 28 and the assembly is ready to be driven from the surface with rod assembly 66.

As FIG. 7 clearly shows, the rotor 68 lands on the reinforced upper section of the stator helix. There are no intervening couplings or large distances that require compensation in the manner the rotor 68 is secured to the rod assembly 66. When landing on the reinforced upper section of the stator helix it is already known that the rotor is fully in the stator 28 and needs only to be lifted the requisite distance with the rod assembly 66 to obtain the proper relative position between the rotor 68 and the stator 28.

Figure 7A:
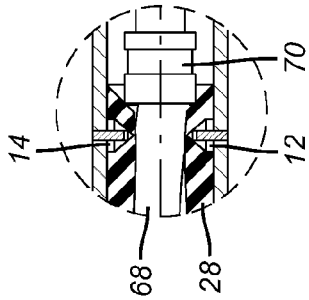
FIG. 7*a* is a detailed view of a part of FIG. 7.

It should also be noted that the fasteners 16 and 18 can be retained with lock nuts, pins or snap rings to keep them from backing out when the stator 28 is manufactured. If the connection to the housing 10 interior wall 32 is with threads then snap rings or set screws can also be used to hold the tags 12 and 14 in position. Preferably the tags 12 and 14 are embedded in the stator helix 28 so that in use leak paths do not develop to any holes for fasteners in the housing 10 or behind the stator helix 28 and in the housing 10. The presence of the tags 12 and 14 gives strength to the top of the stator helix 28 so that it can support the rotor stop 70 when it lands as shown in FIG. 7*a*.

As alternative embodiments to embedded and preferably metallic tags 12 and 14 being disposed in the stator helix 28, the tags 12 and 14 can be non-metallic discrete structures from helix 28 or they can actually be integrated into the structure of the helix 28. For example, the stator helix 28 can be a composite of discrete rubber shapes with the tags 12 and 14 being a harder rubber that is initially placed and secured in the housing 10 before the stator helix 28 is formed in the manner described above. Alternatively, as the stator helix 28 is formed, the rubber formulation can be changed so that the upper end winds up being stiffer or harder to the point where the stator helix assembled in this manner as a unitary rubber, for example, structure can act as a travel stop to the rotor 68.

The above description is illustrative of the preferred embodiment and many modifications may be made by those skilled in the art without departing from the invention whose scope is to be determined from the literal and equivalent scope of the claims below.

I claim:

1. A progressing cavity pump for subterranean use, comprising:

a housing;

a stator helix mounted in said housing, said housing having an upper end, said stator helix comprising a reinforced upper section said reinforced upper section comprising opposed components supported by said housing and embedded in said stator helix;

said opposed components having opposed facing ends that extend axially and are disposed apart;

a rotor having an enlarged segment, which upon insertion of said rotor into said stator helix, lands on said reinforced upper section as a travel stop for said rotor for proper subsequent operational positioning of said rotor with respect to said stator helix to develop pressure needed to move fluid at the subterranean location.

2. The pump of claim 1, wherein:

said reinforced upper section of the stator helix further comprises a reinforcing assembly discrete from said stator helix and secured to said housing when said stator helix is formed in said housing.

3. The pump of claim 1, wherein:

said reinforced upper section of the stator helix further comprises a reinforcing assembly secured to an internal wall of said housing.

4. The pump of claim 3, wherein:

at least a portion of said reinforcing assembly is embedded in said stator helix.

5. The pump of claim 4, wherein:

said reinforcing assembly comprises at least one taper.

6. The pump of claim 5, wherein:

said reinforcing assembly comprises a shape that conforms to the shape of an internal wall of said housing; and said opposed facing ends have straight faces.

7. The pump of claim 6, wherein:

said opposed components comprise tapered sides that lead from the shape that conforms to the inner wall to said straight faces;

said opposed components have a passage therethrough such that the material that forms said stator helix is disposed in said passage.

8. The pump of claim 7, wherein:

said conforming shape comprises a portion at a spaced relation to said internal housing wall defining a gap and said stator helix is in part disposed in said gap;

said housing has an opening and a fastener that extends therethrough into said shape to retain said shape to said internal housing wall;

said shape comprises a bore to receive said fastener.

9. The pump of claim 7, wherein:

said opposed components are welded to said housing.

10. The pump of claim 7, wherein:

said opposed components are integrated into a single piece that is threaded, pinned or secured with at least one snap ring to said housing.

11. The pump of claim 1, wherein: said opposed components comprise a shape that conforms to the shape of an internal wall of said housing.

12. The pump of claim 11, wherein: said opposed facing ends have straight faces.

13. The pump of claim 12, wherein: said opposed components are disposed 180 degrees apart to present parallel opposed ends.

14. The pump of claim 12, wherein:

said opposed components comprise tapered sides that lead from said respective ends that conform to the shape to the inner wall to said respective straight faces.

15. The pump of claim 12, wherein:

said opposed components have a passage therethrough such that the material that forms said stator helix is disposed in said passage.

16. The pump of claim 11, wherein:

said conforming shape comprises a portion at a spaced relation to said internal housing wall defining a gap and said stator helix is in part disposed in said gap.

17. The pump of claim 16, wherein:

said housing has an opening and a fastener that extends therethrough into said shape to retain it to said internal housing wall.

18. The pump of claim 17, wherein:

said shape comprises a bore to receive said fastener.

19. The pump of claim 18, wherein:

said bore is threaded to engage said fastener;

said opposed components have a passage therethrough such that the material that forms said stator helix is disposed in said passage;

said bore extends on opposed sides of said passage.

20. The pump of claim 19, wherein:

said bore is blind on one side of said passage and said fastener spans said passage to extend into said blind bore.

21. The pump of claim 1, wherein:

said reinforced upper section comprises an embedded structure in said stator helix that is substantially non-metallic.

22. The pump of claim 1, wherein:

said reinforced upper section is integral to said stator helix and is harder.

23. The pump of claim 22, wherein:

said stator helix is made substantially of rubber with said reinforced upper section being a different formulation.

* * * * *